United States Patent [19]

Baizer et al.

[11] 4,132,611

[45] * Jan. 2, 1979

[54] ADDITION OF ORGANIC ELECTROPHILES TO CARBON ACIDS VIA CATALYSIS BY ELECTROGENERATED BASES

[75] Inventors: Manuel M. Baizer; Richard D. Goodin, both of St. Louis; Richard C. Hallcher, Maryland Heights, all of Mo.

[73] Assignee: Monsanto Company, St. Louis, Mo.

[ * ] Notice: The portion of the term of this patent subsequent to Feb. 7, 1995, has been disclaimed.

[21] Appl. No.: 794,775

[22] Filed: May 9, 1977

[51] Int. Cl.[2] ..... C25B 3/00; C25B 3/10

[52] U.S. Cl. ..... 204/59 R; 204/72

[58] Field of Search ..... 204/59 R, 72, 59 F, 204/73 R

[56] References Cited

U.S. PATENT DOCUMENTS

| | | | |
|---|---|---|---|
| 3,764,492 | 10/1973 | Baizer et al. | 204/59 R |
| 3,864,225 | 2/1975 | Tysee | 204/59 R |
| 3,962,348 | 6/1976 | Benninger et al. | 260/615 F |
| 3,992,435 | 11/1976 | Donohue et al. | 260/475 R |
| 4,022,672 | 5/1977 | Alverez et al. | 204/59 R |
| 4,024,032 | 5/1977 | Weinberg | 204/59 R |
| 4,072,583 | 2/1978 | Hallcher et al. | 204/59 R |

*Primary Examiner*—F.C. Edmundson

*Attorney, Agent, or Firm*—Wendell W. Brooks; John D. Upham; Joseph D. Kennedy

[57] ABSTRACT

Organic electrophiles are added to carbon acids via catalysis by electrogenerated bases to yield carbon acid-organic electrophile addition products.

38 Claims, No Drawings

ADDITION OF ORGANIC ELECTROPHILES TO CARBON ACIDS VIA CATALYSIS BY ELECTROGENERATED BASES

BACKGROUND OF THE INVENTION

This invention relates to the use of electrogenerated bases as catalysts for the addition of organic electrophiles to carbon acids.

Electrochemical reduction of organic compounds often afford strongly basic and/or nucleophilic species, for example, carbanions, radical anions, dianions, and the like. The nucleophilic character of these species has been extensively exploited in many coupling, polymerization, displacement, and carboxylation reactions — as reported, for example, in *Organic Electrochemistry* (Baizer, ed.) Marcel Dekker, New York, pp. 679–704; 947–974; Baizer et al, *Journal of Organic Chemistry,* 37, 1951 (1972); and Tysee, U.S. Pat. No. 3,945,896.

However, their basicity has been used in synthesis only to a limited extent. For example, the synthetic utilization of electrogenerated bases in the Wittig reaction, the Stevens rearrangement, and the Michael addition reaction has been described, respectively, in Iverson et al, *Tetrahedron Letters,* 3523 (1969), Iverson, *Tetrahedron Letters,* 55 (1971); and Baizer et al, *Tetrahedron Letters,* 5209 (1973).

The progress of synthetic utilization of electrogenerated bases has been impeded by the usual requirement that the electrogenerated base must be present in stoichiometric amounts, an unappealingly wasteful and expensive requirement. And even in those reactions where the electrogenerated base need be present in only catalytic amounts, for example, the Michael addition reaction noted hereinabove, the utility of such bases has been severely limited in that little, if any, advantage is demonstrated over corresponding chemical procedures. Moreover, when a portion of the reactants is converted to the electrogenerated base to serve as a catalyst, that portion of the reactant is "wasted " with respect to the product, thereby producing a lower maximum yield of product (unless such reactant is recovered and subsequently reused). Such a disadvantage is encountered in the electrogenerated base-catalyzed Michael addition reaction and Stevens rearrangement of the prior art.

An additional disadvantage of direct electroreduction of the reactants to the electrogenerated base and/or carbon acid anion is that higher than desirable cathode potentials are in general required, thereby increasing the possibility of side reactions to produce undesired by-products.

Furthermore, processes employing electrogenerated bases as catalysts in the addition of organic electrophiles to carbon acids have been glaringly unavailable, possibly because of the general expectation that such bases would successfully compete with the carbon acid anion for the available in situ organic electrophile, thereby producing little, if any, carbon acid-organic electrophile addition product.

These and other difficulties and disadvantages encountered in the prior art processes of synthetic utilization of electrogenerated bases are overcome by the discovery that the addition of organic electrophiles to carbon acids is conveniently accomplished via catalysis by electrogenerated base to yield the carbon acid-organic electrophile and addition product.

SUMMARY OF THE INVENTION

According to the present invention, it has been discovered that the addition of organic electrophiles to carbon acids is conveniently accomplished via catalysis by electrogenerated bases in anhydrous aprotic solvents to yield the carbon acid-organic electrohile addition product.

DETAILED DESCRIPTION OF THE INVENTION

The present invention is characterized by the use of electrogenerated bases as catalysts for the addition of organic electrophiles to carbon acids to yield carbon acid-organic electrophile addition products. The addition according to the present process is effected at a lower cathode potential than that which would be required for direct electro-reduction or electro-conversion of the carbon acid to the carbon acid anion. This result is achieved because the probases suitable for use in the present process are more easily electro-reduced to the electrogenerated bases than are the carbon acids to the carbon acid anions. In fact, the probases are, and indeed must be, more easily electro-reduced than any of the other components of the anhydrous aprotic electrolysis medium as discussed hereinbelow.

The term "organic electrophile" is employed herein to mean an organic reagent that acts to acquire electrons in chemical reactions.

The term "carbon acid-organic electrophilic addition product" is employed herein to describe the product resulting from the reaction of the carbon acid anion with the organic electrophile, regardless of whether the entire organic electrophile or only a portion thereof, which portion may or may not be organic, is added to the carbon acid.

In accordance with the present process, a direct electric current is passed through an anhydrous aprotic liquid electrolysis medium comprising the probase or base precursor, the carbon acid, the organic electrophile, an anhydrous aprotic solvent, and supporting electrolyte. The process, which occurs in situ within the electrolysis cell, comprises:

(a) electro-reducing the probase at the cathode by electrolysis to produce an electrogenerated base;

(b) deprotonating the carbon acid with the electrogenerated base to produce a carbon acid anion and the conjugate acid of the electrogenerated base, and (c) reacting the carbon acid anion with the organic electrophile to yield a carbon acid-organic electrophile addition product.

Equations (1), (2), and (3) illustrate the general reactions involved $$PB \xrightarrow{\textit{electro-reduction}} EGB^- \quad (1)$$

$$EGB^- + RH \rightarrow EGBH^{\cdot} + R^- \quad (2)$$

$$R^- + \text{Organic Electrophile} \rightarrow \text{Carbon Acid-Organic Electrophile Addition Product} \quad (3)$$

wherein PB is a probase; $EGB^-$ is an electrogenerated base; RH is a carbon acid of sufficiently low $pk_a$ (high acid strength) to permit or allow deprotonation by the electrogenerated base; $R^-$ is the carbon acid anion or conjugate base of the carbon acid; and EGBH is the conjugate acid of the electrogenerated base.

Using azobenzene as an example of a probase, Equation (1) may be illustrated in greater detail by Equation (4) wherein the electrogenerated base is a dianion.

$$C_6H_5N{=}N{-}C_6H_5 \xrightarrow{\text{electro-reduction}} C_6H_5{-}N^-{-}N^-{-}C_6H_5 \quad (4)$$

Examples of Equation (3) reactions in which organic electrophiles are added to carbon acid anions include reactions illustrated by Equations (5), (6), and (7). In each of these Equations the carbon acid anion, $R^-$, is generated by the abstraction of a proton from the carbon acid, RH, by the electrogenerated base, $EGB^-$, [Equation (2)].

(5) Alkylation—

$$R^- + R'X \rightarrow RR' + X^-$$

wherein R' is a primary lower alkyl group of 1 to 6 carbon atoms, and X is a halogen selected from the group consisting of chlorine, bromine, and iodine;

Example:

$$C_6H_5\overline{C}HCOOCH_3 + CH_3CH_2Br \longrightarrow C_6H_5\underset{\underset{CH_2CH_3}{|}}{C}HCOOCH_3$$

(6) Halogenation—

$$R^- + CX_4 \rightarrow RX + C^-X_3$$

wherein X is as defined in Equation (5);

Example:

$$C_6H_5\overline{C}HCOOCH_3 + CCl_4 \longrightarrow C_6H_5\underset{\underset{Cl}{|}}{C}HCOOCH_3 + \overline{C}Cl_3$$

(7) Condensation —

$$R^- + RH \rightarrow [RRH]^- \xrightarrow{RH} RRH_2 + R^-$$

Example:

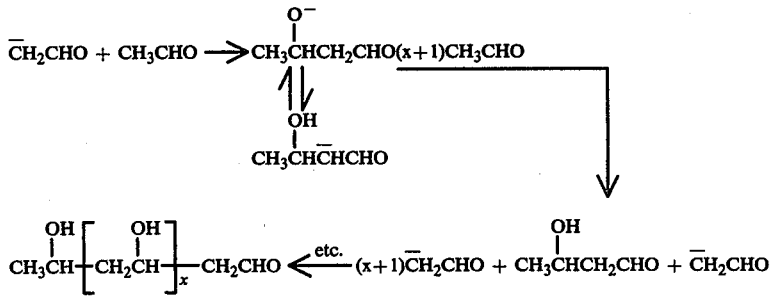

wherein X is any integer.

It will of course be recognized that the electrogenerated bases may also participate in base-catalyzed isomerization reactions wherein carbon acids sensitive to isomerization by bases undergo base catalyzed isomerization. Using an allyl compound for illustrative purposes, the base-catalyzed isomerization reaction may be illustrated by Equation (8):

(8) Base-catalyzed Isomerization—

$$CH_2{=}CHCH{-}Y \rightarrow CH_3CH{=}CH{-}Y$$

wherein Y is an unsaturated functional group, including nitro, carbonyl, cyano, sulfone, and phenyl.

It is well known of course that the presence of strongly electronegative unsaturated groups—nitro, carbonyl, cyano, sulfone, or phenyl groups, for example—at a saturated carbon atom renders any hydrogen atom bonded to that carbon atom relatively acidic. As a result, beta , gamma-unsaturated compounds containing such functionalities are easily isomerized by base catalysis to the corresponding thermodynamically more stable alpha, beta-unsaturated compounds in which the strongly electronegative unsaturated group and the alpha, beta-unsaturated double bond are conjugated.

Thus the base-catalyzed isomerization of carbon acids selected from the group consisting of beta, gamma-unsaturated nitro, carbonyl, cyano, sulfone, and phenyl compounds to the corresponding alpha, beta-unsaturated nitro, carbonyl cyano, sulfone, and phenyl carbon acid compounds via catalysis by electrogenerated bases may be effected in accordance with the present process which comprises:

(a) electro-reducing a probase at the cathode by electrolysis in an anhydrous aprotic liquid electrolysis medium comprising the probase, the beta, gamma-unsaturated carbon acid, an anhydrous aprotic solvent, and supporting electrolyte to produce the electrogenerated base;

(b) deprotonating the beta, gamma-unsaturated carbon acid with the electrogenerated base to produce delocalized allylic anion and the conjugate acid of the electrogenerated base; and (c) protonating the delocalized allylic anion in the beta position to yield the corresponding alpha, beta-unsaturated nitro, carbonyl, cyano, sulfone, and phenyl carbon acid compound.

The term "delocalized allylic anion" as employed herein has its usual recognized meaning of a carbon acid anion having the negative charge delocalized over three adjacent carbons.

It will be noted that when practical, it is advantageous that the conjugate acid of the electrogenerated base is capable of being readily reoxidized to the probase and recycled as shown by Equation (9).

$$EGBH \xrightarrow{\text{Oxidation}} PB + H^+ \quad (9)$$

Such a reoxidation, however, is not necessary for the successful completion of the process of the present invention.

It is apparent from Equation (9) that the reoxidation of the conjugate acid of the electrogenerated base to the probase will generate protons (or water), and it will be necessary to counteract the undesirable and deleterious effects of such species as shown in Equation (10).

$H^+$ + Scavenger → Innocuous Scavenger Reaction Product (10)

This is especially necessary if the reoxidation is carried out in the preferred in situ manner as discussed hereinbelow.

It will be further noted, however, that in certain instances, for example, the halogenation reaction exemplified in Equation (6), the conjugate acid of the electrogenerated base may be available in its own right. As a result, reconversion of the conjugate acid of the electrogenerated base to the probase by oxidation may be less desirable, or even altogether undesirable.

The probases which are generally suitable for use in the practice of the present invention are those which satisfy the following requirements:

(a) the probase must be more easily electro-reducible than the carbon acid;

(b) the probase must be more easily electro-reducible than other components of the anhydrous aprotic electrolysis medium;

(c) the probase must not be attacked nucleophilically by either the carbon acid anion (except when the probase and the organic electrophile are the same compound, for example, carbon tetrachloride) or the electrogenerated base;

(d) the electrogenerated base must react nucleophilically with the organic electrophile either not at all, very slowly, or rapidly reversible; and (e) the electrogenerated base must be a strong enough base to deprotonate the carbon acid.

In addition, the probase should be easily regenerated from the conjugate acid of the electrogenerated base for reuse as a reactant, or, alternatively, the conjugate acid of the electrogenerated base should be usable as a co-product having equal or greater value than the probase.

Typical among the probases which generally satisfy requirements (a) through (e) hereinabove, as well as the reoxidation capability, are azobenzenes (including sterically hindered azobenzenes) and ethenetetracarboxylate tetraesters. Examples of the azobenzenes are azobenzene, 2,2-di-t-butylazobenzene, and the like, 2,2',6,6'-tetrasubstituted azobenzenes, for example, 2,2',6,6'-tetraethylazobenzene and the like. Illustrative examples of the ethenetetracarboxylate tetraesters include tetraalkyl ethenetetracarboxylate esters such as, for example, tetramethyl ethenetetracarboxylate, tetraethyl ethenetetracarboxylate, tetran-n-propyl ethenetetracarboxylate, tetra-i-propyl ethenetetracarboxylate, tetra-n-butyl (and isomers thereof) ethenetetracarboxylate, tetra-n-pentyl (and isomers thereof) ethenetetracarboxylate, tetran-n-hexyl (and isomers thereof) ethenetetracarboxylate, tetra-n-heptyl (and isomers thereof) ethenetetracarboxylate, tetra-n-ocytl (and isomers thereof) ethenetetracarboxylate, tetra-n-nonyl (and isomers thereof) ethenetetracarboxylate, tetra-n-decyl (and isomers thereof) ethenetetracarboxylate, and the like.

Among the azobenzenes, the sterically hindered azobenzenes are generally preferred in that the steric bulk of the substituents tends to minimize nucleophilic attack on the probase by either the carbon acid anion or the electrogenerated base. Electrophilic attack on the electrogenerated base by the organic electrophile is also minimized by the presence of such substituents.

Among the tetraalkyl ethenetetracarboxylate esters, those having alkyl groups larger than methyl, such as, for example, tetraethyl ethenetetracarboxylate, tetra-n-butyl (and isomers thereof) ethenetetracarboxylate, tetra-n-hexyl (and isomers thereof) ethenetetracarboxylate, tetra-n-decyl (and isomers thereof) ethenetetracarboxylate, and the like are more preferred because so long as all other requirements are met, the larger the alkyl groups in the tetraalkyl ethenetetracarboxylate esters the more pronounced will be the tendency to minimize, or eliminate altogether, nucleophilic attack on the probase by either the carbon acid anion or the electrogenerated base. Among the tetraalkyl ethenetetracarboxylate esters having alkyl groups larger than methyl, those having alkyl groups containing from two (2) to four (4) carbon atoms, for example, tetraethyl ethenetetracarboxylate, tetra-n-propyl ethenetetracarboxylate, tetra-i-propyl ethenetetracarboxylate, and tetra-n-butyl (and isomers thereof) ethenetetracarboxylate are preferred because in general no additional advantage is offered by the tetraalkyl ethenetetracarboxylate esters having alkyl groups containing greater than four carbon atoms, that is, alkyl groups larger than butyl groups.

The term "and isomers thereof" following the names of various alkyl groups is employed herein to designate the isomers of the preceding alkyl group. For example, "and isomers thereof" following "tetra-n-butyl" designates isomeric butyl groups (other than n-butyl), such as i-butyl, s-butyl, and t-butyl. Thus the term "tetra-n-butyl (and isomers thereof) ethenetetracarboxylate" designates tetra-n-butyl ethenetetracarboxylate, tetra-i-butyl ethenetetracarboxylate, tetra-s-butyl ethenetetracarboxylate, and tetra-i-butyl ethenetetracarboxylate.

It will be noted that since there are four ester moieties contained in the ethenetetracarboxylate tetraesters as employed herein, the alkyl groups in the tetraalkyl ethenetetracarboxylate esters can be the same or different; however, for practical reasons it is preferred that the alkyl groups contained in the four moieties be the same.

Typical among the probases which generally meet requirements (a) through (e) hereinabove, as well as the valuable co-product capability are the carbon tetrahalides selected from the group consisting of carbon tetrachloride, carbon tetrabromide, and carbon tetraiodide. Of these, carbon tetrachloride is preferred in that it is a liquid at process temperature and is readily available. Moreover, the conjugate acid of the electrogenerated base, chloroform, formed by the abstraction of a proton from the carbon acid by the electrogenerated base, the trichloromethyl carbanion, is a valuable article of commerce. In fact, it is more valuable than the probase, carbon tetrachloride.

It will be noted that when a carbon tetrahalide is employed as the probase, the electrogenerated base, a trihalomethyl carbanion, is continually regenerated as the reaction proceeds. For example, a chloride is easily removed from carbon tetrachloride (the organic electrophile) as an electrophile by the carbon acid anion to give a chlorinated carbon acid as the carbon acid-organic electrophile addition product [Equation (6)]. The removal of the chloride simultaneously generates another trichloromethyl carbanion to continue the process.

From the above discussion, it will be apparent that when a carbon tetrahalide is employed as the probase, it may simultaneously serve as the organic electrophile, particularly when employed in a stoichiometric excess. Thus the probase and the organic electrophile may in fact be the same compound when appropriate compounds are employed. In a similar sense, the carbon acid and the organic electrophile may be the same compound, for example, in condensation reactions [Equation (7)].

The carbon acid suitable for use in the present process must be strong enough to permit deprotonation by the electrogenerated base to form the corresponding carbon acid anion. In addition, the carbon acid anion ideally is a weak nucleophile, particularly toward the probase (except as noted hereinabove). Exemplary of the carbon acids which can be used in the practice of the present invention are N-alkyldiglycolimides, for example, N-methyldiglycolimide; dialkyl diglycolates, for example, diethyl diglycolate; 9-arylfluorenes, for example, 9-phenylfluorene; alkyl phenylacetates, for example, methyl phenylacetate; alkyl acetates, for example, ethyl acetate; aliphatic aldehydes, for example, acetaldehyde; and the like. Carbon acids capable of undergoing base-catalyzed isomerization are selected from the group consisting of [Equation (8)] beta, gamma-unsaturated nitro, carbonyl, cyano, sulfone, and phenyl compounds. Illustrative examples of such compounds include alkyl cyanide(3-cyanopropene), 3-nitropropene, ethyl vinylacetate (3-carboethoxypropene), allylbenzene (3-phenylpropene), allyl phenyl sulfone (3-phenylsulfonylpropene), 3-pentenenitrile, 2-methyl-3-butenenitrile, 2-methyl-3-pentenenitrile, 3-cyanocyclohexene, and the like. Such beta, gamma-unsaturated compounds are in general isomerized to the corresponding thermodynamically more stable alpha, beta-unsaturated compound. The latter compounds may be of course undergo further reaction, for example, addition, condensation, and the like, as shown by Equation (11), with allyl cyanide (and azobenzene as the probase) being used for illustrative purposes.

(11)

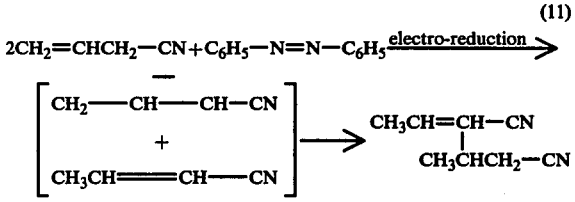

Organic electrophiles suitable for use in the present process are capable of undergoing the desired reaction with the carbon acid anion to yield the carbon acid-organic electrophile addition product without simultaneously causing an adverse side reaction. These include lower alkyl halides of 1 to 6 carbon atoms, for example, methyl iodide, n-propyl bromide, n-propyl iodide, i-butyl chloride, i-butyl bromide, i-butyl iodide, and the like; carbon tetrahalides selected from the group consisting of carbon tetrachloride, carbon tetrabromide, and carbon tetraiodide (all of which are suitable as probases); alkyl acetates, for example, ethyl acetate; aliphatic aldehydes, for example, acetaldehyde; alpha, beta-unsaturated nitro, carbonyl, cyano, sulfone, and phenyl compounds, for example, crotononitrile, ethyl crotonate, ethyl cinnamate, acrylonitrile; and the like.

It will be noted that certain of the compounds suitable for use as organic electrophiles, for example, the alkyl acetates and the aliphatic aldehydes, are, as noted hereinabove, also suitable for use as carbon acids [Equation (7)].

As indicated hereinabove, the electrolysis of the present process is effected by passing a direct electric current through an anhydrous aprotic liquid electrolysis medium comprising a probase, a carbon acid, an organic electrophile, an anhydrous aprotic solvent, and supporting electrolyte, which medium is in contact with a cathode. The medium must have sufficient conductivity to conduct the electric current. While media of less than ideal conductivity can be employed, it is preferred from an economic viewpoint not to have too high a resistance. The required conductivity is generally achieved by employing common supporting electrolytes, such as electrolyte salts whose cations have sufficiently negative discharge potentials, along with an anhydrous aprotic liquid solvent having a fairly good dielectric constant. In general, any combination of electrolyte and solvent can be employed which gives the desired conductivity and is sufficiently compatible with the starting materials and species generated therefrom to permit the addition of the organic electrophile to the carbon acid to yield the desired carbon acid-organic electrophile addition product. It is generally desirable to have the electrolyte, probase, carbon acid, and anhydrous aprotic solvent in a homogeneous solution. It will be noted, however, that many quaternary ammonium salt solutions may, in some respects, be dispersions rather than true solutions. In this regard, the present invention may use emulsions as well as true solutions so long as sufficient amounts of the probase (and the electrogenerated base generated therefrom), the carbon acid (and the carbon acid anion produced therefrom), and organic electrophile are dissolved or in solution so as to permit the desired addition to occur.

The addition of organic electrophiles to carbon acids via catalysis by electrogenerated bases of the present process must be carried out in scrupulously anhydrous media. This is necessary because water, a stronger acid than the carbon acids employed herein, would provide a source of more readily abstractable protons than that provided by the carbon acid. The presence of water, or for that matter any other source of similarly labile protons, would at worst effectively prevent altogether, or at best seriously impede the formation of the desired and necessary carbon acid anion, which ultimately is the species to which the organic electrophile is being added to produce the desired carbon acid-organic electrophile addition product. In other words, the electrolysis medium must not contain an acid stronger than the carbon acid to which the organic electrophile is to be added.

In the solvents employed in the present process it will generally be desirable to select a solvent (a) which is aprotic in nature; (b) which is a weaker acid than the carbon acid to which the organic electrophile is to be added; (c) whose liquid range is such that ease of removal on product work-up is facilitated but loss by evaporation under process conditions is minimized; (d) which is relatively inert under process conditions; and (e) which has a sufficiently high dielectric constant in order to lower electrical resistance. It will be understood, however, that the choice and concentration of electrolyte can also be used to lower electrical resistance.

The term "relatively inert" is employed herein to describe solvents which, under process conditions, (a) do not preferentially undergo electrochemical reaction and (b) do not significantly react with either the starting materials, intermediates generated therefrom, or the desired final product (carbon acid-organic electrophile addition product).

Solvents desirable for use in the practice of the present process have, in addition to characteristics (a) through (e) set forth hereinabove, low electrophilicity; that is, suitable solvents are substantially non-electrophilic. Further, it is found in practice that it is generally desirable to employ a solvent with a dielectric constant of at least 25, and preferably of at least 50. Examples of such anhydrous aprotic solvents include, for example, acetonitrile, propionitrile, dimethylformamide, N,N-dimethylacetamide, and the like.

In carrying out the present process, a supporting electrolyte is generally used to enhance conductivity, a "supporting electrolyte," as understood by those in the art, is an electrolyte capable of carrying electric current but not discharging under electrolysis conditions. In the present invention this primarily concerns discharge at the cathode, as the desired reaction occurs at the cathode. It will, of course, be recognized by those skilled in the art that, under certain conditions, discharge at the anode may also have a deleterious effect on the course of the reaction, product distribution, and overall product yield. The proper choice of a supporting electrolyte, however, is generally sufficient to either prevent any adverse effect as a result of the anodic discharge or to turn it to a useful advantage. In any event, the electrolyte employed will generally have cations of more negative discharge potential than the reduction potential of the probase used to generate the electrogenerated base. An electrolyte with a similar or slightly lower discharge potential than the reduction potential of the probase may be operative to some extent, but yields and current efficiency are adversely affected, so it is generally desirable to avoid any substantial discharge of the electrolyte salt during the electrolysis.

It will be recognized that discharge potentials will vary with cathode materials and their surface conditions, and various materials in the electrolysis medium. In order for the reaction to proceed, however, it is only necessary to have an effective electro-reduction of the probase to generate the electrogenerated base under process conditions. Thus some electrolyte salts may be effective supporting electrolytes under process conditions even though nominally of less negative discharge potential than the probase employed.

In general, any supporting electrolyte salts can be utilized in carrying out the present process, with due consideration to having conditions suitable for discharge of the probase involved. The term "salt" is employed in its generally recognized sense to indicate a compound composed of a cation and an anion, such as produced by a reaction of an acid with a base. The electrolyte salts can be organic, inorganic, or mixtures of such, and composed of simple cations and anions or very large complex cations and anions.

Certain salts of alkali metals, amine and quaternary ammonium salts, or mixtures of such can be employed as supporting electrolytes. Among the alkali metal salts useful are lithium, sodium, and potassium salts. Among the quaternary ammonium salts useful are the tetraalkylammonium, for example, tetramethylammonium, tetraethylammonium, tetra-n-propylammonium, and the like, heterocyclic and alkylarylammonium salts, for example, phenyltriethylammonium, and the like, with the tetralkylammonium salts being generally preferred because of their good solubility and conductivity and because they are difficultly reduced.

The term "quaternary ammonium" as employed herein has its usual recognized meaning of a cation having four organic groups substituted on the nitrogen.

Various anions can be used with the foregoing and other cations including, for example, halides such as chloride, bromide, and iodide, perchlorates, tetrafluoroborates, hexafluorophosphates, sulfonates, tetraphenylborides, and the like. Aromatic sulfonates and similar anions, including those referred to as McKee salts, can be used, as can other hydrotropic salts, although the hydrotropic property may be of no particular significance when employed with anhydrous solvents or solvents having very low water content. Among these and other anions, the halides may be advantageously employed because of their ready availability and because of their ability to serve as convenient anodic depolarizers, particularly in undivided cells where otherwise the anode might adversely affect the reaction product. Of the halide anions, the bromide ion is preferred because the molecular bromine generated therefrom by oxidation at the anode has the ability, when desired and practical, to oxidize the conjugate acids of the electrogenerated bases, for example, hydrazobenzenes and ethane-1,1,2,2-tetracarboxylate tetraesters, to the corresponding probases. Simultaneously, the molecular bromine exhibits little, if any tendency to adversely react with other components of the electrolysis medium, such as, for example, solvent, starting materials, and the like. This particular ability of molecular bromine is uniquely advantageous in that continuous regeneration of the probase provides a continuous source of electrogenerated base from only catalytic amounts of probase. Also, the source of the bromine is not of critical importance; it can be provided either as indicated hereinabove, by anodic oxidation of bromide ions, or by chemical means. Anodic oxidation, however, is preferred in that continuous operation is more easily effected and the possibility of product contamination by extraneous material is avoided.

The iodide ion, although suitable for use in the present process, is less preferred than the bromide ion because molecular iodine is not a sufficiently strong oxidizing agent to oxidize ethane-1,1,2,2-tetracarboxylate tetraesters to the corresponding ethenetetracarboxylate tetraesters. As a result, the continuous operation of the process is made more difficult.

The chloride ion is less preferred than the iodide ion because molecular chlorine generated therefrom reacts with the solvent to generate undesired protons as a by-product, unless a chlorine trap, for example, 1-hexene, is employed to trap the molecular chlorine generated during the electrolysis, for example, as 1,2-dichlorohexane.

The term "chlorine trap" is employed herein to describe a compound capable of reacting with molecular chlorine to form innocuous products which have little or no adverse effect upon either the course of the reaction or upon product yield.

Thus the halide ions are preferred in the order of bromide ion > iodide ion > chloride ion.

The perchlorate anion may also be advantageously employed because of its ready availability, its inertness toward electrolytic oxidation and reduction, and its almost complete lack of complex formation. It is also one of the least nucleophilic species known.

The concentration of electrolyte salts is not narrowly critical. Thus, for example, suitable concentrations will often be in the range of about 1.0 percent to about 10 percent by weight of the electrolysis medium, or, on a molar basis, often in the range of about 0.001 to about 1.0 molar. The only limitation on the amount of electrolyte salt employed is that the amount is sufficient to promote efficient and economical operation and that it is soluble in the electrolysis medium. Thus electrolyte salts, for example, sodium chloride, which are incapable of being dissolved to any appreciable extent in the solvents of choice are generally not suitable for use in the practice of the present invention.

In regard to the solubility of the electrolyte salt in the electrolysis medium, it is important to note that certain alkali metal salts, for example, sodium bromide, are only slightly soluble in the solvents of choice in the present invention, for example, acetonitrile. When such difficultly soluble salts are employed, it is necessary to employ agents capable of inducing solubilization of such salts in the solvents of choice. Agents which are particularly useful for this purpose are compounds commonly known as crown ethers.

Crown compounds, in general, are macroheterocycles containing the repeating unit $(—Z—CH_2CH_2—)_n$ where Z may be a heteroatom, for example, oxygen, sulfur, nitrogen, or phosphorus. Of these, the most important are the crown ethers of the macrocyclic polyether class where Z is an oxygen. Thus these molecules in general contain repeating units $(—O—CH_2CH_2—)_n$ where n is equal to or greater than 2. Also, the ethylene units may be unsubstituted or substituted.

It will be recognized, however, that although crown compounds are defined as cycles, certain open-chain or acyclic compounds containing repeating units as defined hereinabove and having suitable sterochemistry for complexing alkali metal ions, while excluded in the formal sense, may behave very much like crown compounds and thereforesimilarly induce solubilization of the difficulty soluble alkali metal salts in the solvents of choice, and in such cases can be used in the present invention as psuedo crown ethers. Such acyclic compounds include the polyglymes, for example, pentaglyme, hexaglyme, and the like.

For a general review of crown ether chemistry and the chemistry of related compounds, see Gokel et al, *Synthesis,* 168–184 (1976), and references cited therein.

A crown ether suitable for use in the present process is 1,4,7,10,13,16-hexaoxacyclooctadecane, commonly known by its trivial name of 18-crown-6. Other crown ethers and psuedo crown ethers where n represents between about 5 and 20, with the ethylene units being either unsubstituted or substituted are also suitable for use in present process so long as they are capable of inducing solubilization of the difficulty soluble electrolyte salts and cause no adverse side effects.

Thus, a solution comprising an anhydrous aprotic solvent, an alkali metal bromide, and a crown ether may be advantageously employed for conducting the addition of organic electrophiles to carbon acids via catalysis by electrogenerated bases of the present process. Additionally, a quaternary ammonium bromide may, if desired, be added to the solution to increase its electric current-conducting capacity. It follows therefore that upon dissolving a probase, a carbon acid, and an orgaic electrophile in the solution, the passage of direct electric current at a cathode potential sufficient to effect electro-reductive generation of the electrogenerated base, but insufficient to effect electro-reduction of other components of the electrolysis medium, will cause the addition of the organic electrophile to the carbon acid according to the present process.

It will be noted, however, that in general the quaternary ammonium salts are highly soluble in the solvents of choice in the present invention. Such salts, therefore, do not suffer from the solubility difficulties associated with certain alkali metal salts, and may be employed as supporting electrolytes without the necessity of employing crown ethers as solubilization agents.

The concentration of the probase employed in the process of the present invention is not critical and limited only by the corresponding concentration of carbon acid employed. That is, sufficient amounts of probase are preferably employed so that the electrogenerated base generated therefrom will be present in sufficient amounts to deprotonate the available carbon acid to form the carbon acid anion. However, the total amount of probase needed to generate sufficient electrogenerated base for the desired deprotonation of the carbon acid present in the electrolysis medium need not actually be included in the electrolysis medium in that the probase can be recycled for reuse to generate additional electrogenerated base for continued deprotonation of the carbon acid. This is particularly true when the process is carried out in a continuous or semi-continuous mode—which involves a continuing series of batch preparations —of operation.

It will be apparent, to those skilled in the art, however, that in those instances in which the probase and the organic electrophile are the same compound, for example, carbon tetrachloride, its concentration will in general be greater than that in those instances in which the probase and the organic electrophile are different species and separate components of the anhydrous aprotic liquid electrolysis medium. In such instances the molar ratio of probase (and organic electrophile) to carbon acid will often be on the order of about 10:1.

Thus, although concentrations as low as 0.01 percent by weight of the electrolysis medium can be employed, for reasons of efficiency and economy, it is preferred to employ concentrations from about 10 percent to about 25 percent by weight, or on a molar basis, from about 0.001 to about 0.1 molar, or even higher, of the probase.

Similarly, the preferred concentration of the carbon acid will often be in the range of about 0.1 percent to about 25 percent by weight of the electrolysis medium, or on a molar basis, from about 0.01 to about 0.15 molar, or even higher.

The molar ratio of probase to carbon acid employed, however, will depend in part upon the number of protons to be abstracted from the carbon acid and the number of active anionic sites on the electrogenerated base which are available for proton abstraction. For example, when only one proton is to be abstracted from the carbon acid and the electrogenerated base has two active anionic sites which are available for proton abstraction, the molar ratio of probase to carbon acid is preferably at least about 1:2 or greater. However, as noted hereinabove, in those instances when the probase and the organic electrophile are the same compound, the molar concentration of the probase (and organic electrophile) to the carbon acid will often be on the order of about 10:1.

The concentration of the organic electrophile is not critical so long as sufficient amounts are present to react with the carbon acid anion to give the carbon acid-organic electrophile addition product. Suitable concentrations will often range from about 0.1 precent to about 10 precent, or on a molar basic, from about 0.01 molar to about 10. molar.

The molar ratio of the organic electrophile to the carbon acid will be on the order of at least 1:1 with a slight excess generally being employed. Such a ratio assumes of course that each of the species, with respect to the present process, has only one reactive site. As noted hereinabove, however, when the organic electrophile and the probase are the same compound, the overall concentration of the organic electrophile (and probase) will correspondingly increase.

As noted hereinabove, when practical, it is advantageous to employ electrogenerated bases whose conjugate acids are capable of being easily oxidized to the corresponding probases. Under such circumstances and conditions, the probase and the electrogenerated base derived therefrom may be employed in only catalytic amounts. In order to provide such a highly desirable effect, means must be provided for carrying out the desired oxidative conversion.

A number of means, including but not limited to those described hereinbelow may be employed to convert the conjugate acid of the electrogenerated base to the probase for reuse as a reactant. The conjugate acid of the electrogenerated base can be (a) reoxidized by air outside the electrolysis cell (followed by drying of the probase prior to it being returned to the electrolysis cell); (b) oxidized directly or indirectly, with or without the assistance of air, in the anode compartment of a divided cell (in the presence of a scavenger to capture the protons (or water) generated so as to prevent migration into the catholyte); or (c) oxidized directly or indirectly, at the anode of an undivided cell (in the presence of a scavenger to capture the protons generated without generating water).

Since options (b) and (c) are, respectively, in situ methods of oxidizing the conjugate acid of the electrogenerated base in a divided cell and an undivided cell, they are the methods of choice.

It is apparent, however, that since protons (or water) will be generated while effecting the desired oxidation, and since the presence of protons in the electrolysis medium in any appreciable quantity would effectively prevent the required proton abstraction from the carbon acid by the electrogenerated base, in order to maintain the economic feasibility of the present process appropriate and effective scavengers must be provided to capture any generated protons (without simultaneously generating water). Such scavengers prevent subsequent deleterious reaction of the generated protons with the electrogenerated base. Scavengers suitable for use in the present process include, for example, alkali metal carbonates; alkali metal salts of very weak and very insoluble acids, for example, alkali metal tetraborates; basic alumina (which contains alkali metal aluminates, for example, sodium aluminates); and acid-type ion exchange resins in the alkali metal form, for example, sulfonic acid-type ion exchange resins in the sodium form. Of these, the alkali metal carbonates are advantgeously employed, particularly as proton scavengers, in that the non-acidic products produced therefrom are the innocuous alkali metal bicarbonates, for example, sodium bicarbonate.

The term "scavenger" is employed herein to mean a compound or species which is capable of capturing protons (or water) to produce innocuous scavenger reaction products, or, more simply, innocuous products. These products are generally nonacidic, although they need not necessarily be such so long as they have little or no adverse effect either upon the course of the reaction or upon the product yield.

From the foregoing discussion, it is evident that ethane-1,1,2,2-tetracarboxylate tetraesters may be oxidized to ethenetetracarboxylate tetraesters by contacting the ethane-1,1,2,2-tetracarboxylate tetraester, dissolved in an anhydrous aprotic solvent containing a scavenger capable of capturing protons, with molecular bromine. And as noted hereinabove, the source of the bromine is not of critical importance; it can be provided by anodic oxidation of bromide ions, or by chemical means. Azobenzenes may be similarly oxidized with molecular bromine or simply by being contacted with air under suitable conditions.

As noted hereinabove, in certain instances the conjugate acid of the electrogenerated base may be valuable in its own right and thereby make reconversion less desirable, or even altogether undersirable. Exemplary of this is the halogenation addition reaction with a carbon tetrahalide, for example, carbon tetrachloride, as the probase and the organic electrophile. Under such conditions, the carbon tetrachloride (as the probase) is electro-reduced to the trichloromethyl carbanion (as the electrogenerated base) and the chloride ion. The trichloromethyl carbanion abstracts a proton from the carbon acid to produce the carbon acid anion and chloroform (as the conjugate acid of the electrogenerated base), which is in fact a more valuable article of commerce than is carbon tetrachloride. The carbon acid anion then reacts with another molecule of carbon tetrachloride (as the organic electrophile) to produce the chlorinated carbon acid (as the carbon acid-organic electrophile addition product) and another trichloromethyl carbanion. The latter species can continue the reaction so long as carbon acid remains. These reactions may be illustrated according to Equations (12), (13), and (14).

$$CCl_4 + 2e^- \rightarrow C^-Cl_3 + Cl^- \quad (12)$$

$$C^-Cl_3 + RH \rightarrow R^- + CHCl_3 \quad (13)$$

$$R^- + CCl_4 \rightarrow RCl + C^-Cl_3 \quad (14)$$

wherein RH and $R^-$ are as defined hereinabove.

In general, the cathode potential can be maintained at a selected value or it can be varied. It will be apparent to those skilled in the art, however, that in order to minimize any possible adverse alteration in the course of the reaction or product distribution, the cathode potential is preferably no greater than that which is necessary to effect the desired electro-reductive generation of the electrogenerated base from the probase. That is, the cathode potential will be sufficiently negative to effect the desired electro-reduction of the probase to the electrogenerated base but insufficiently negative to effect any undesired additional reduction of other components of the electrolysis medium, such as, for example, the carbon acid and/or the organic electrophile (except under circumstances noted hereinabove). Suitable cathode potentials will often be no more than bout −3.0 volts (versus the silver wire pseudo reference electrode) and usually no more than about −2.7 volts (versus the silver wire pseudo reference electrode). It will be recognized, however, that the value will vary with cathode materials and their surface conditions, and various materials in the electrolysis medium.

Various current densities can be employed in the present process. It will be desirable to employ high current densities in order to achieve high use of electrolysis cell capacity, and therefore for production purposes it will generally be desirable to use as high a density as feasible, taking into consideration sources and cost of electrical current, resistance of the electrolysis medium, heat dissipation, effect upon yields, and the like. Over broad ranges of current density, the density will not greatly affect the yield. Suitable ranges for efficient operation will generally be in the ranges from a few milliamperes per square centimeter of cathode surface, up to 10 or more milliamperes per square centimeter.

The present electrolysis can be conducted in the various types of cells known to the art. In general, such cells comprise a container made of material capable of resisting action of electrolytes, for example, glass or plastic, and one or more anodes and cathodes electrically connected to sources of direct electric current. The anode can be of any electrode material so long as it is relatively inert under reaction conditions. Anode materials suitable for use in the present process include, for example, platinum, palladium, graphite rods, graphite felt, graphite fibers, and the like.

Any suitable material can be employed as the cathode, various metals, alloys, graphite, and the like being known to the art. For example, mercury, platinum, lead, cadmium, copper amalgam, and graphite felt are suitable.

In the present process, either an unidivided or a divided cell can be employed. A divided cell contains a suitable barrier material or separator which will prevent the free flow of reactants between the cathode and anode. Generally, the separator is some mechanical barrier which is relatively inert to electrolyte material, for example, a fritted glass filter, glass cloth, asbestos, porous poly(vinyl chloride), and the like. An ion exchange membrane can also be employed.

When a divided cell is used, it will be possible to employ the same electrolysis medium on both the cathode and anode sides, or to employ different media. Ordinarily, it will be desirable to employ the same electrolyte salt and solvent on both the cathode and anode sides; however, in some circumstances, it may be desirable to employ a different anolyte for economy of materials, lower electrical resistance, and the like.

As noted hereinabove, an unidivided cell is also suitable for use in the present process. It will be appreciated that this could have advantages for industrial production in that electrical resistance across a cell divider is eliminated.

The electrolysis cells employed in the procedural Examples hereinbelow are primiarily for laboratory demonstration purposes. Production cells are usually designed with a view to the economics of the process, and characteristically have large electrode surfaces, and short distances between electrodes.

For a general description of various laboratory scale cells, see Lund et al, "Practical Problems in Electrolysis," in *Organic Electrochemistry* (Baizer, ed.) Marcel Dekker, New York, 1973, pp. 165–249, and for some consideration of industrial cell designs, see Danly, "Industrial Electroorganic Chemistry," in ibid, pp. 907–946.

The present process is suited to batch, semi-continuous, or continuous operations. An examplary method of conducting the semi-continuous operations comprises:

(a) charging to the cathode compartment of a divided electrolysis cell a catholyte medium comprising a probase, a carbon acid, an organic electrophile, an anhydrous aprotic solvent and supporting electrolyte;

(b) charging to the anode compartment of the divided electrolysis cell an anolyte medium comprising the conjugate acid of the electrogenerated base generated from the probase, the anhydrous aprotic solvent, supporting electrolyte, and scavenger;

(c) passing a direct electric current through the electrolysis cell to produce a carbon acid-organic electrophile addition product and the conjugate acid of the electrogenerated base in the catholyte, and the probase and an innocuous scavenger reaction product in the anolyte;

(d) separating the carbon acid-organic electrophile addition product from the catholyte;

(e) removing the unreacted scavenger and the innocuous scavenger reaction product from the anolyte;

(f) charging to the anode compartment the catholyte from step (d) containing the conjugate acid of the electrogenerated base, with added scavenger;

(g) charging to the cathode compartment the anolyte from step (e) containing the probase, with added organic electrophile; and (h) repeating steps (c) through (h).

In carrying out such a semi-continuous operations process additional reactants and electrolyte salt or other electrolyte components can be augmented and replenished as appropriate.

Continuous operations can involve recirculation of a flowing electrolyte stream, or streams between the electrodes, with continuous or intermittent sampling of the stream for product removal. Similarly, additional reactants can be added continuously or intermittently, and electtrolyte salt or other electrolyte components can be augmented, replenished, or removed as appropriate.

The temperature at which the process of the present invention is conducted is not critical. However, it may be desirable to avoid excessively high or elevated temperatures in that increased production of undesirable by-products may result. It may also be desirable to avoid elevated temperatures if volatile materials, for example, solvents, are utilized so that such materials will not escape, and various cooling means can be used for this purpose. Cooling to ambient temperatures is sufficient, but, if desired, temperatures down to 0° C or lower can be employed so long as the temperature is sufficient to permit the desired generation of the electrogenerated base followed by proton abstraction from the carbon acid and subseuqent additiion of the organic electrophile to the carbon acid anion to occur. The amount of cooling capacity needed for the desired degree of control will depend upon the cell resistance and the electric current drawn. If desired, cooling can be effected by immersing the electrolysis cell in an ice or ice-salt bath or by permitting a component, such as the solvent, to reflux through a cooling condenser.

For convenience, temperatures in the range of about 0° C to about 100° C can be used, with temperatures between about 20° C and about 55° C being preferred.

The process of the present invention can be conducted at atmospheric pressure, superatomospheric pressures, and subatmospheric pressures. However, for reasons of economy and ease of construction of equipment employed in the present process, it is preferred to conduct this process at approximately atmospheric pressure.

The carbon acid-organic electrophile addition products obtained in the present process can be readily recovered by any of a number of well-known and conventional procedures. It will be understood, however, that the procedures employed in the Examples and discussed hereinbelow are primarily for illustrative purposes.. Other procedures can be employed, and may be preferred, for commercial use.

Upon completion of the electrolysis, the catholyte is evaporated in vacuo. The resultant residue is extracted with an appropriate organic solvent, for example, diethyl ether, methylene chloride, and the like, washed with water, and dried over an appropriate desiccant, for example, anhydrous magnesium sulfate. Evaporation of the organic solvent provides the carbon acidorganic electrophile addition product. If desired, purification of the addition product may be effected by fractional distillation at appropriate temperature and pressure conditions when it is a liquid or an oil. When the carbon acid-organic electrophile addition product is a solid, it may be purified by recrystallization from a suitable solvent.

Alternatively, the catholyte is poured into water, extracted with an appropriate organic solvent, for example, diethyl ether, washed with water, dilute aqueous mineral acid, and water, and dried over an appropriate desiccant, for example, anhydrous magnesium sulfate. Evaporation of the organic solvent in vacuo provides the product, which may be purified as described hereinabove.

The following examples illustrate the present invention and the manner by which it can be practiced.

EXAMPLE 1

A three-compartment cell having a cathode compartment, anode compartment, and a buffer compartment located between the cathode and anode compartments was employed. The cathode and anode compartments were each separated from the buffer compartment by a medium porosity glass frit. The cathode was a 2.5 centimeters ×5.0 centimeters 45 mesh platinum guaze strip and the anode was a 0.635 centimeter (0.25 inch) outside diameter carbon rod. The cathode compartment contained a gas inlet and outlet for passing gas through the catholyte as desired. A silver wire electrode inserted into a glass tube capped by a 0.1 centimeter medium porosity frit at the end to be immersed in the catholyte was placed near the cathode surface to serve as a pseudo reference electrode. Stirring in the cathode compartment was accomplished by a magnetic stirrer.

The entire procedure was carried out in a dry nitrogen flushed dry box.

To the cathode compartment was charged 70 milliliters of 0.1 molar solution of tetra-n-butylammonium perchlorate in dry dimethylformamide (dried by successive filtrations through a 5-foot (152.4-centimeter) column of Linde type 4A molecular sieves and a 20-centimeter column of active neutral alumina) 0.50 grams (0.0021 mole) of 9-phenylfluorene, and 3.08 grams (0.02 mole, 2 milliliters) of carbon tetrachloride. Each of the anode and buffer compartments were charged with 30 milliliters and 20 milliliters, respectively, of the 0.1 molar solution of tetrabutylammonium perchlorate in dry dimethylformamide. The catholyte was deoxygenated by passing dry argon therethrough. Thereafter, dry carbon dioxide was continuously bubbled through the catholyte during the electrolysis in an attempt to capture any 9-phenylfluorene anion formed.

The electrolysis was carried out at ambient temperatures (without temperature controls) at a cathode potential of −1.0 volt (versus the silver wire pseudo reference electrode) and a current of 100 milliamperes until a total of 620 coulombs (0.0064 or 3.06 Faraday per mole of 9-phenylfluorene) had passed. The catholyte turned flesh-colored during the course of the electrolysis.

Upon completion of the electrolysis, excess methyl iodide was added to the solution (to trap any carboxylated material). Stirring was continued for an additional 10 minutes. The cell was removed from the dry box and the dimethylformamide, excess carbon tetrachloride, and other volatile materials were removed by vacuum aspiration. The resultant residue was extracted with diethyl ether, washed with water, and dried over anhydrous magnesium sulfate. Evaporation of the ether under reduced pressure yielded a reddish oil which was shown by nuclear magnetic resonance spectroscopic and gas chromatographic analyses to contain 9-chloro-9-phenylfluorene, 9-hydroxy-9-phenylfluorene, 9-phenylfluorene starting material, and unidentified materials in the percentage ratio of 75:6:17:2.

EXAMPLE 2

The entire procedure was carried out in a nitrogen-flushed dry box, using the electrolysis apparatus described in EXAMPLE 1 above.

To the cathode compartment was charged 70 milliliters of 0.1 molar solution of tetra-n-butylammonium perchlorate in dry dimethylformamide, 0.33 gram (0.002 mole) of ethyl phenylacetate, and 3.1 grams (0.02 mole, approximately 2 milliliters) of carbon tetrachloride. Each of the anode and buffer compartments were charged with 30 milliliters and 20 milliliters, respectively, of the 0.1 molar solution of tetra-n-butylammonium perchlorate in dimethylformamide. The catholyte was deoxygenated by passing dry argon therethrough prior to the passage of current.

The electrolysis was carried out a ambient temperature (without temperature control) at a cathode poential of −1.2 volts (versus the silver wire pseudo reference electrode) and a current of 100 milliamperes until a total of 579 coulombs (0.006Faraday or 3.0 Faraday per mole of ethyl phenylacetate had passed. The catholyte became a very dark color during the course of the electrolysis.

The cell was removed from the dry box and the catholyte placed in a round bottomed flask. The more volatile components were removed by vacuum (pump) aspiration and collected in a dry ice/acetone-cooled trap. Gas chromatographic analysis of the distillate showed the presence of chloroform and carbon tetrachloride as chlorinated products in dimethylformamide in the percentage ratio of 11:89 (theory 15:85).

The residue following removal of the volatile components (distillate) was extracted with diethyl ether, washed with water, and dried over anhydrous magnesium sulfate. Evaporation of the ether in vacuo yielded a residue which was shown by gas chromatographic and nuclear magnetic resonance spectroscopic analyses to contain ethyl dichlorophenylacetate, ethyl chlorophenylacetate, and ethyl phenylacetate starting material in the percentage ratio of 39:4:57.

The current efficiency for the chlorinated products was 53 percent.

EXAMPLE 3

2-t-Butylnitrobenzene (30.0grams, 0.17 mole) in 100 milliliters of ether was added to a suspension of 8.22 grams (0.22 mole) of lithium aluminum hydride in 700 milliliters of ether at a temperature of 5 - 10° C. The mixture was allowed to come to ambient temperature and stirred for an additional 0.5-hour period. Hydrolysis was accomplished by the successive addition of 15 milliliters of water, 15 milliliters of 20 percent aqueous sodium hydroxide, and 30 milliliters of water. After mixing for 2 hours, the inorganic salts were removed by filtration and the ether evaporated. The residue was applied to an activated neutral alumina column (200 grams, 80–200 mesh) and eluted with hexane at a flow rate of 10 drops per minute. The initial fractions (about 700 milliliters) were discarded and the product, a bright red band on the column, was collected. Evaporation of the hexane followed by crysta-lization of the residue from ethanol gave 4.6 grams (18.7 percent) of 2,2'-di-t-butylazobenzene melting point, 90–91° C.

The 2,2,'-di-t-butylazobenzene can also be prepared according to the procedure described in Smith et al, *Journal of Organic Chemistry,* 34, 3430 (1969).

The entire procedure was carried out in a nitrogen-flushed dry box. The electrolysis apparatus described in EXAMPLE 1 above was employed except that the cathode compartment was equipped with a dropping funnel.

The cathode compartment was charged with 70 milliliters of 0.1 molar solution of tetra-n-butylammonium perchlorate in dry dimethylformamide (dried as described in EXAMPLE 1 above), 0.26 gram (0.0017 mole) of methyl phenylacetate, and 0.25 gram (0.00085 mole) of 2,2'-di-t-butylazobenzene. Each of the anode and buffer compartments were charged with 30 milliliters and 20 milliliters, respectively, of the 0.1 molar solution of tetra-n-butylammonium perchlorate in dry dimethylformamide. The dropping funnel was charged with a solution of 0.204 gram (0.0019 mole) of ethyl bromide in 5 milliliters of dry dimethylformamide. The catholyte was deoxygenated by passing dry argon therethrough prior to the passage of current.

The electrolysis was carried out at ambient temperature at a cathode potential of −1.7 volts (versus the silver wire pseudo reference electrode). The current was maintained at less than 100 milliamperes to prevent heating in the cell. As the electrolysis proceeded the ethyl bromide solution was added dropwise in proportion to the amount of current passed.

After the passage of 120 coulombs, the current began to increase (possibly due to migration of acidic impurities from the anolyte to the catholyte). At 195 coulomb passage, an additional 100 microliters of ethyl bromide were added, causing the catholyte to become lighter in color. After 225 coulombs had been passed, the catholyte had become light gold in color. The electrolysis was terminated and another 100 microliters of ethyl bromide were added to the catholyte. Thereafter, the cell was removed from the dry box and the catholyte worked up as described in EXAMPLE 1 above to give a residue containing a quantitative yield of methyl 2-phenylbutanoate as well as a 6 percent yield of azo cleavage products.

EXAMPLE 4

The entire procedure (charging and electrolysis) was carried out in a nitrogen-flushed dry box. The electrolysis apparatus described in EXAMPLE 3 was employed except that the dropping funnel was removed and the cathode was a 1.0 centimeter × 2.0 centimeters 45 mesh platinum gauze strip (in order to moderate current levels and prevent cell heating at the more negative potentials).

The cathode compartment was charged with 70 milliliters of 0.1 molar tetra-n-butylammonium perchlorate in dry dimethylformamide (dried as described in EXAMPLE 1 above), 0.51 gram (0.0034 mole) of methyl phenylacetate, 0.14 gram (0.0015 mole) of i-butyl chloride, and 0.20 gram (0.00068 mole) of 2,2'-di-t-butylazobenzene. Each of the anode and buffer compartments were charged with 30 milliliters and 20 milliliters, respectively, of a 0.1 molar solution of tetra-n-butylammonium iodide in dry dimethylformamide. The catholyte was deoxygenated by passing dry argon therethrough prior to the passage of current.

The electrolysis was conducted at ambient temperature at a cathode potential of −2.7 volts (versus the silver pseudo reference electrode). The initial current of 100 milliamperes rapidly decreased to 27 milliamperes, accompanied by some gas evolution and thereafter remained constant. As the electrolysis proceeded the i-butyl chloride solution was added dropwise in proportion to the amount of current passed.

After the passage of 288 coulombs, the electrolysis was terminated and an additional 200 microliters of i-butyl chloride added. The catholyte was stirred an additional 40 minutes. The cell was then removed from the dry box and the catholyte worked up as described in EXAMPLE 1 above to give a reddish residue which contained methyl 4-methyl-2-phenylpentanoate (methyl 4-methyl-2-phenylvalerate) and methyl phenylacetate starting material in the percentage ratio of 60:40.

EXAMPLE 5

The entire charging and electrolysis procedure was carried out in a nitrogen-flushed dry box. The electrolysis apparatus described in EXAMPLE 3 above was employed.

The cathode compartment was charged with 70 milliliters of a 0.1 molar solution of tetramethylammonium perchlorate in dry dimethylformamide, 0.37 gram (0.0055 mole) of allyl cyanide, and 0.05 gram (0.00028 mole) of azobenzene. The anode compartment and the buffer compartment were charged, respectively, with 30 and 20 milliliter portions of the 0.1 molar solution of tetramethylammonium perchlorate in dry dimethylformamide. The catholyte was deoxygenated by passing dry argon therethrough prior to the passage of current.

The electrolysis was conducted at ambient temperatures at a cathode potential of −1.5 volts (versus the silver wire pseudo reference electrode) and a current of 40 milliamperes until a total of 2.0 coulombs had passed. The electrolysis was terminated and the catholyte stirred an additional 30 minutes. The addition of triethylammonium bromide to quench the reaction caused an immediate decoloration of the dark colored catholyte to an orange color. The catholyte was poured into 700 milliliters of cold water and extracted with three 50-milliliter portions of ether. The combined ether extracts were washed successively with 50-millilieter portions of water and dilute sulfuric acid, two 50-milliliter portions of water, 50 milliliters of saturated aqueous sodium chloride, and dried over anhyrous magnesium sulfate. Evaporation of the ether in vacuo gave an orange oil which was shown by gas chromatographic and nuclear magnetic resonance spectroscopic analyses to be composed primarily of the crotononitrile dimer, 4-cyano-3-methyl-4-hexenenitrile (or 2-ethylidene-3-methyl-1,5-pentanedinitrile), and azobenzene, (apparently by air oxidation of hydrazobenzene). Small amounts of unidentified compounds were also present.

EXAMPLE 6

To a stirred mixture of 3.18 grams (0.01 mole) of tetraethyl ethane-1,1,2,2-tetracarboxylate dissolved in 40 milliliters of anhydrous acetonitrile containing 2.12 grams (0.02 mole) of suspended sodium carbonate was added 1.6 grams (0.01 mole) of bromine under a nitrogen atmosphere. The mixture was stirred at 40° C for two hours, cooled to ambient temperatures, and filtered to remove undissolved solid material (sodium carbonate/sodium bicarbonate mixture). Gas liquid chromatographic analysis of the filtrate showed the presence of tetraethyl ethenetetracarboxylate in quantitative yield.

The carbon acid-organic electrophile addition products produced in the present process are suitable for numerous purposes. For example, the condensation product from repeated additions of acetaldehyde, poly(acetaldol), (Equation (7), Example), on being subjected to reduction of the end aldehyde functionality, yields poly(vinyl alcohol). Poly(vinyl alcohol) is a known article of commerce which finds use in the plastics industry in moulding compounds, surface coatings, films resistant to gasoline, textile sizes and finishing compositions. The halogenation products [Equation (6)] find known use as chemical intermediates and as solvents in the chemical industry. The alkylation products [Equation (5)] find similar use as solvents in the chemical industry and, depending on the nature of other functional groups present in the product, for example, cyano, ester, and the like, as chemical intermediates.

While the invention has been described with respect to various specific examples and embodiments thereof, it will be understood that the invention is not limited thereto and that many alternatives, modifications, and variations will be apparent to those skilled in the art in light of the foregoing description. Accordingly, it is intended to embrace all such alternatives, modifications and variations as fall within the spirit and broad scope of the invention.

What is claimed is:

1. A process for the addition of organic electrophiles to carbon acids via catalysis by electrogenerated bases, which process comprises:

(a) electro-reducing a probase at the cathode by electrolysis in an anhydrous aprotic liquid electrolysis medium comprising the probase, the carbon acid, the organic electrophile, an anhydrous aprotic solvent, and supporting electrolyte to produce the electrogenerated base;

(b) deprotenating the carbon acid with the electrogenerated base to produce a carbon acid anion and the conjugate acid of the electrogenerated base; and (c) reacting the carbon acid anion with the organic electrophile to yield a carbon acid-organic electrophile addition product;

with the aforesaid probase being more easily electroreducible than the carbon acid and producing an electrogenerated base strong enough to deprotonate the carbon acid which is strong enough to permit such deprotonation, and the electrogenerated base not reacting readily, unless rapidly reversibly, with the organic electrophile.

2. The process of claim 1 wherein the probase is an azobenzene.

3. The process of claim 2 wherein the azobenzene is azobenzene.

4. The process of claim 2 wherein the azobenzene is 2,2'-di-t-butylazobenzene.

5. The process of claim 1 wherein the probase is an ethenetetracarboxylate tetraester.

6. The process of claim 5 wherein the ethenetetracarboxylate tetraester is tetraethyl ethenetetracarboxylate.

7. The process of claim 1 wherein the probase and the organic electrophile are the same compound.

8. The process of claim 7 wherein the compound is carbon tetrachloride.

9. The process of claim 1 wherein the carbon acid is an alkyl phenylacetate.

10. The process of claim 9 wherein the alkyl phenylacetate is methyl phenylacetate.

11. The process of claim 1 wherein the carbon acid and the organic electrophile are the same compound.

12. The process of claim 11 wherein the compound is an aliphatic aldehyde.

13. The process of claim 12 wherein the aliphatic aldehyde is acetaldehyde.

14. The process of claim 1 wherein the organic electrophile is a loweralkyl halide of 1 to 6 carbon atoms.

15. The process of claim 14 wherein the loweralkyl halide is ethyl bromide.

16. The process of claim 14 wherein the loweralkyl halide is i-butyl chloride.

17. The process of claim 1 wherein the anhydrous aprotic solvent is dimethylformamide.

18. The process of claim 1 wherein the anhydrous aprotic solvent is acetonitrile.

19. The process of claim 1 wherein the supporting electrolyte is a quaternary ammonium salt.

20. The process of claim 19 wherein the quaternary ammonium salt is tetra-n-butylammonium perchlorate.

21. The process of claim 19 wherein the quaternary ammonium salt is tetra-n-butylammonium bromide.

22. The process of claim 1 wherein the supporting electrolyte is an alkali metal halide.

23. The process of claim 22 wherein the alkali metal halide is sodium bromide.

24. The process of claim 1 wherein the supporting electrolyte is a mixture of a quaternary ammonium salt and an alkali metal halide.

25. The process of claim 24 wherein the supporting eleectrolyte is a mixture of tetraethylammonium bromide and sodium bromide.

26. The process of claim 1 wherein the electrolysis medium further comprises a crown ether.

27. The process of claim 26 wherein the crown ether is 18-crown-6.

28. The process of claim 1 wherein a platinum cathode and a graphite rod anode are used.

29. The process of claim 1 wherein the concentration of the probase is between about 1.0 percent and about 25 percent by weight; the concentration of the carbon acid is between about 0.1 percent and about 25 percent by weight; the concentration of the organic electrophile is betweeen about 0.1 percent and about 10 percent by weight; the cathode potential is sufficient to effect electro-reductive generation of the electrogenerated base from the probase but insufficient to effect electro-reduction of other components of the electrolysis medium;

and the electrolysis is conducted at temperatures between about 20° C and about 55° C.

30. The process of claim 29 wherein the cathode potential is no more than about −3.0 volts versus the silver wire pseudo reference electrode.

31. The process of claim 29 wherein the probase is 2,2′-di-t-butylazobenzene; the carbon acid and the organic electrophile are both acetaldehyde; the supporting electrolyte is tetra-n-butylammonium perchlorate; and the carbon acid-organic electrophile addition product is poly(acetaldol).

32. The process of claim 29 wherein the probase and the organic electrophile are both carbon tetrachloride; the carbon acid is methyl phenylacetate; the supporting electrolyte is tetra-n-butylammonium perchlorate; and the carbon acid-organic electrophile addition products are methyl 2-chlorophenylacetate and methyl 2,2-dichlorophenylacetate.

33. The process of claim 29 wherein the probase is azobenzene; the carbon acid is allyl cyanide; the organic electrophile is crotononitrile; the supporting electrolyte is tetramethylammonium perchlorate; and the carbon acid-organic electrophile addition product is 4-cyano-3-methyl-4-hexenenitrile.

34. The process of claim 33 wherein the crotoninitrile is produced by in situ base-catalyzed isomerization of allyl cyanide.

35. The process of claim 1 wherein the conjugate acid of the electrogenerated base is oxidized to the probase, in the presence of a scavenger capable of capturing generated protons to produce innocuous scavenger reaction products, and recycled.

36. The process of claim 35 wherein the scavenger is sodium carbonate and the innocuous scavenger reaction product is sodium bicarbonate.

37. A semi-continuous addition of organic electrophiles to carbon acids via catalysis by electrogenerated bases process which comprises (a) charging to the cathode compartment of a divided electrolysis cell a catholyte medium comprising a probase, a carbon acid, an organic electrophile, an anhydrous aprotic solvent, and supporting electrolyte;

(b) charging to the anode compartment of the divided electrolysis cell an anolyte medium comprising the conjugate acid of the electrogenerated base generated from the probase, the anhydrous aprotic solvent, supporting electrolyte, and scavenger;

(c) passing a direct electric current through the electrolysis cell to produce a carbon acid-organic electrophile addition product and the conjugate acid of the electrogenerated base in the catholyte, and the probase and an innocuous scavenger reaction product in the anolyte;

(d) separating the carbon acid-organic electrophile addition product from the catholyte;

(e) removing the unreacted scavenger and the innocuous scavenger reaction product from the anolyte;

(f) charging to the anode compartment the catholyte from step (d) containing the conjugate acid of the electrogenerated base, with added scavenger;

(g) charging to the cathode compartment the anolyte from step (e) containing the probase, with added organic electrophile; and (h) repeating steps (c) through (h).

38. A process for the base-catalyzed isomerization of carbon acids selected from the group consisting of beta, gamma-unsaturated nitro, carbonyl, cyano, sulfone and phenyl compounds to the corresponding alpha,beta-unsaturated nitro, carbonyl, cyano, sulfone, and phenyl carbon acid compounds, via catalysis by electrogenerated bases, which process comprises:

(a) electro-reducing a probase at the cathode by electrolysis in an anhydrous aprotic liquid electrolysis medium comprising the probase, the beta, gamma-unsaturated carbon acid, an anhydrous aprotic solvent, and supporting electrolyte to produce the electrogenerated base;

(b) deprotonating the beta, gamma-unsaturated carbon acid with the electrogenerated base to produce a delocalized allylic anion and the conjugate acid of the electrogenerated base; and (c) protonating the delocalized allylic anion in the beta position to yield the corresponding alpha, beta-unsaturated nitro, carbonyl, cyano, sulfone, and phenyl carbon acid compound.

* * * * *